US005679627A

United States Patent [19]

Beltzer et al.

[11] Patent Number: 5,679,627

[45] Date of Patent: Oct. 21, 1997

[54] HIGH-LOAD CARRYING TURBO OILS CONTAINING AMINE PHOSPHATE AND A SULFUR CONTAINING CARBOXYLIC ACID (LAW348)

[75] Inventors: Morton Beltzer, Westfield; Paul Joseph Berlowitz, East Windsor; Jeenok T. Kim, Holmdel, all of N.J.

[73] Assignee: Exxon Research & Engineering Company, Florham Park, N.J.

[21] Appl. No.: 577,660

[22] Filed: Dec. 22, 1995

[51] Int. Cl.[6] ..... C10M 105/32; C10M 141/02; C10M 141/06; C10M 141/08

[52] U.S. Cl. ..... 508/437

[58] Field of Search ..... 508/437, 509, 508/570, 571

[56] References Cited

U.S. PATENT DOCUMENTS

| | | | |
|---|---|---|---|
| 2,398,202 | 4/1946 | Zublin et al. | 508/509 |
| 3,755,176 | 8/1973 | Kinney et al. | 508/509 |
| 3,859,218 | 1/1975 | Jervis et al. | 252/32.5 |
| 4,119,550 | 10/1978 | Davis et al. | 252/45 |
| 4,130,494 | 12/1978 | Shaub et al. | 252/32.5 |
| 4,536,308 | 8/1985 | Pehler et al. | 252/41 |
| 4,559,153 | 12/1985 | Baldwin et al. | 252/56 R |
| 4,820,430 | 4/1989 | Farng et al. | 252/48.6 |

FOREIGN PATENT DOCUMENTS

| | | | |
|---|---|---|---|
| 0227948A2 | 7/1987 | European Pat. Off. | C08K 5/00 |
| 0434464A1 | 6/1991 | European Pat. Off. | C10M 141/08 |
| 63-210194 | 8/1988 | Japan . | |
| 63-265997 | 11/1988 | Japan | C10M 173/02 |
| 1287647 | 9/1972 | United Kingdom | C10M 3/40 |

*Primary Examiner*—Margaret Medley
*Attorney, Agent, or Firm*—Joseph J. Allocca

[57] ABSTRACT

This invention relates to synthetic based turbo oils, preferably polyol ester-based turbo oils which exhibit exceptional load-carrying capacity by use of a synergistic combination of sulfur (S)-based and phosphorous (P)-based load additives. The S-containing additive of the present invention is sulfur containing carboxylic acid (SCCA), preferably the $C_1$–$C_4$ thioether carboxylic acid and the P-containing component is one or more amine phosphates. The turbo oil composition consisting of the dual P/S additives of the present invention achieves an excellent load-carrying capacity, which is better than that obtained when each additive was used alone at a comparable treat rate to the total combination additive treat rate, and this lower concentration requirement of each additive allows the turbo oil composition to meet or exceed US Navy MIL-L-23699 requirements including Oxidation and Corrosion Stability and Si seal compatibility.

12 Claims, No Drawings

HIGH-LOAD CARRYING TURBO OILS CONTAINING AMINE PHOSPHATE AND A SULFUR CONTAINING CARBOXYLIC ACID (LAW348)

BACKGROUND OF THE INVENTION

1. Field of the Invention

This invention relates to synthetic oil-based, preferably polyol ester-based turbo oils which use a synergistic combination of phosphorous (P)-based and sulfur (S)-based load additive chemistries which allows the turbo oil formulation to impart high load-carrying capacity and also to meet or exceed US Navy MIL-L-23699 requirements including Oxidation and Corrosion Stability and Si seal compatibility.

Load additives protect metal surfaces of gears and bearings against uncontrollable wear and welding as moving parts are heavily loaded or subjected to high temperatures. Incorporating high load-carrying capacity into a premium quality turbo oil without adversely impacting other properties can significantly increase the service life and reliability of the turbine engines.

The mechanism by which load additives function entails an initial molecular adsorption on metal surfaces followed by a chemical reaction with the metal to form a sacrificial barrier exhibiting reduced friction between the rubbing metal surfaces. In the viewpoint of this action, the effectiveness as load-carrying agent is determined by the surface activity imparted by a polar functionality of a load additive and its chemical reactivity toward the metal; these features can lead to a severe corrosion if not controlled until extreme pressure conditions prevail. As a result, the most of effective load additives carry deleterious side effects on other key turbo oil performances: e.g., corrosion, increased deposit forming tendency and elastomer incompatibility.

2. Description of the Prior Art

U.S. Pat. No. 4,820,430-A discloses the lubricant composition containing a copper salt of a propionic acid derivative or an additive prepared by reacting a suitable thiodipropionic add derivative with a suitable alcohol or amine-containing compound to impart multifunctional and antioxidant characteristics.

JP 63,265,997-A is directed to odorless aqueous lubricants useful as hydraulic fluid. The lubricant composition comprises a thiodicarboxylic acid, and preferably amine(s) or/and hydroxide(s) of alkali(ne earth) metals.

IP 63,210,194-A discloses thermally and oxidatively stable lube useful as compressor oil, turbo-charger oil, etc. that contains thiodipropionate ester obtained from thiodipropionic acid and tertiary alcohol.

EP 227,948-A discloses a polyolefin stabilizing composition containing a tris-alkyl-phenyl phosphite (I) and a dialkyl-thio-dipropionate (II). II synergistically enhances the stabilizing effectiveness of I to improve the melt-processing and color stability of the polyolefin.

EP 434,464 is directed to lube composition or additive concentrate comprising metal-free antiwear and load-carrying additives containing sulfur and/or phosphorous, and an amino-succinate ester corrosion inhibitor. The antiwear and load additives include mono- or di-hydrocarbyl phosphate or phosphite with the alkyl radical containing up to $C_{12}$, or an amine salt of such a compound, or a mixture of these; or mono- or dihydrocarbyl thiophosphate where the hydrocarbon (HC) radical is aryl, alkylaryl, arylalkyl or alkyl, or an amine salt thereof; or trihydrocarbyl dithiophosphate in which each HC radical is aromatic, alkylaromatic, or aliphatic; or amine salt of phosphorothioic acid; optionally with a dialkyl polysulfide and/or a sulfurized fatty acid ester.

U.S. Pat. No. 4,130,494 discloses a synthetic ester lubricant composition containing ammonium phosphate ester and ammonium organo-sulfonate, especially useful as aircraft turbine lubricants. The aforementioned lubricant composition have good extreme pressure properties and good compatibility with silicone elastomers.

U.S. Pat. No. 3,859,218 is directed to high pressure lube composition comprising a major portion of synthetic ester and a minor portion of load-bearing additive. The load-carrying additive package contains a mixture of a quaternary ammonium salt of mono-($C_1$–$C_4$) alkyl dihydrogen phosphate and a quaternary ammonium salt of di-($C_1$–$C_4$) alkyl monohydrogen phosphate. In addition to the improved high pressure and wear resistance, the lubricant provides better corrosion resistance and cause less swelling of silicone rubbers than known oils containing amine salts of phosphoric and thiophosphoric acids.

DETAILED DESCRIPTION

A turbo oil having unexpectedly superior load-carrying capacity comprises a major portion of a synthetic base oil selected from diesters and polyol ester base oil, preferably polyol ester base oil, and minor portion of a load additive package comprising a mixture of amine phosphate and sulfur containing carboxylic acid (SCCA).

The diester basestock, which can be used in the high load-carrying lube composition of the present invention is formed by esterification of linear or branched $C_6$ to $C_{15}$ aliphatic alcohols with one of such dibasic acids as sebacic, adipic, azelaic acids. Examples of diester are di-2-ethyhexyl sebacate, di-octyl adipate.

The preferred synthetic base stock which is synthetic polyol ester base oil is formed by the esterification of aliphatic polyols with carboxylic acids. The aliphatic polyols contain from 4 to 15 carbon atoms and have from 2 to 8 esterifiable hydroxyl groups. Examples of polyols are trimethylolpropane, pentaerythritol, dipentaerythritol, neopentyl glycol, tripentaerythritol and mixtures thereof.

The carboxylic acid reactants used to produce the synthetic polyol ester base oil are selected from aliphatic monocarboxylic acids or a mixture of aliphatic monocarboxylic acids and aliphatic dicarboxylic acids. The carboxylic acids contain from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the structural formula

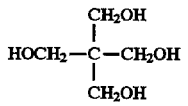

and about 12% of dipentaerythritol having the structural formula

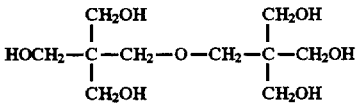

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the synthetic oil base stock is added a minor portion of an additive comprising a mixture of one or more amine phosphate(s) and SCCA.

The amine phosphate used includes commercially available monobasic amine salts of mixed mono- and di-acid phosphates and specialty amine salt of the diacid phosphate. The mono- and di-acid phosphate amines have the structural formula:

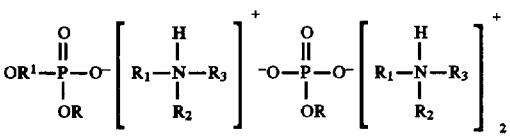

where R and $R^1$ are the same or different and are $C_1$ to $C_{12}$ linear or branched chain alkyl $R_1$ and $R_2$ are H or $C_1$ to $C_{12}$ linear or branched chain alkyl $R_3$ is $C_4$ to $C_{12}$ linear or branched chain alkyl, or aryl-$R_4$ or $R_4$-aryl where $R_4$ is H or $C_1$–$C_{12}$ alkyl, and aryl is $C_6$.

The preferred amine phosphates are those wherein R and $R^1$ are $C_1$–$C_6$ alkyl, and $R_1$ and $R_2$ are H or $C_1$–$C_4$, and $R_3$ is aryl-$R_4$ where $R_4$ is linear chain $C_4$–$C_{12}$ alkyl or $R_3$ is linear or branched chain $C_8$–$C_{12}$ alkyl.

The molar ratio of the mono- and diacid phosphate amine in the commercial amine phosphates of the present invention ranges from 1:3 to 3:1. Mixed mono-/di-acid phosphates and just diacid phosphate can be used, with the latter being the preferred.

The amine phosphates are used in an mount by weight in the range 50 to 300 ppm (based on base stock), preferably 75 to 250 ppm, most preferably 100 to 200 ppm amine phosphate.

Materials of this type are available commercially from a number of sources including R. T. Vanderbilt (Vanlube series) and Ciba Geigy.

Sulfur containing carboxylic acids are described by the structural formula:

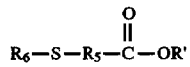

where $R_5$ is $C_1$–$C_{12}$ alkyl, aryl, $C_1$ to $C_8$ alkyl substituted aryl, R' is hydrogen, $R_6$ is hydrogen, $C_1$–$C_{12}$ alkyl, aryl, $C_1$ to $C_8$ alkyl substituted aryl, or the group

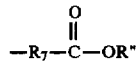

and wherein when $R_6$ is

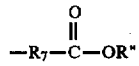

$R_5$ and $R_7$ are the same or different $C_1$–$C_{12}$ alkyl, aryl, $C_1$–$C_8$ alkyl substituted aryl and R' and R" are the same or different and are hydrogen, $C_1$–$C_8$ alkyl provided that at least one of R' and R" is hydrogen.

Representative of sulfur containing carboxylic acids corresponding to the above description are mercapto carboxylic acids of the formula

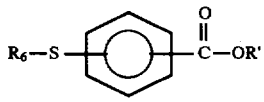

and its various isomers where $R_6$ and R' are as previously defined, preferably $R_6$ and R' are hydrogen, and thioether carboxylic acids (TECA) of the structural formula:

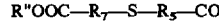

where $R_5$ and $R_7$ are same or different and are $C_1$–$C_{12}$ alkyl and R' and R" are the same or different and are H or $C_1$–$C_8$ alkyl provided that at least one of R' and R" are hydrogen.

The preferred TECA are those wherein $R_5$ and $R_7$ are $C_1$–$C_4$ linear alkyl and R' and R" are both hydrogen.

The sulfur containing carboxylic acids are used in an amount by weight in the range 100 to 1000 ppm (based on polyol ester base stock), preferably 100 to 600 ppm, most preferably 100 to 300 ppm.

The amine phosphate and the SCCA are used in the weight ratio of 1:1 to 1:10, preferably 1:1.5 to 1:5, most preferably 1:2 to 1:3 amine phosphate:SCCA.

The synthetic oil based, preferably polyol ester-based high load-carrying oil may also contain one or more of the following classes of additives: antioxidants, antifoamants, antiwear agents, corrosion inhibitors, hydrolytic stabilizers, metal deactivator, detergents. Total amount of such other additives can be in the range 0.5 to 15 wt %, preferably 2 to 10 wt %, most preferably 3 to 8 wt %.

Antioxidants which can be used include aryl amines, e.g., phenyl-naphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an mount in the range 0.5 to 4 wt %, preferably 1 to 3 wt %.

Corrosion inhibitors include, but are not limited to, various triazols, e.g., tolyl triazol, 1,2,4-benzene triazol, 1,2,3-benzene triazol, carboxy benzotriazole, alkylated benzotriazol and organic diacids, e.g., sebacic acid.

The corrosion inhibitors can be used in an mount in the range 0.02 to 0.5 wt %, preferably 0.05% to 0.25 wt %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11, the disclosures of which are incorporated herein by reference.

The turbo oils of the present invention exhibit excellent load-carrying capacity as demonstrated by the severe FZG gear and 4 Ball tests, while meeting or exceeding the Oxidation and Corrosion Stability (OCS) and Si seal compatibility requirements set out by the United States Navy in MIL-L-23699 Specification. The polyol ester-based turbo oils to which have been added a synergistic mixture of the amine phosphate and the sulfur containing carboxylic acid produce a significant improvement in antiscuffing protection of heavily loaded gears/balls over that of the same formulations in the absence of the amine phosphate and the sulfur containing carboxylic acid, and furthermore, attain the higher load capability than that achieved with one of these two additives used alone.

The present invention is further described by reference to the following non-limiting examples.

EXPERIMENTAL

EXAMPLE 1

In the following examples, a series of fully formulated aviation turbo oils were used to illustrate the performance benefits of using a mixture of the amine phosphate and TECA in the load-carrying, OCS and Si seal tests. A polyol ester base stock prepared by reacting technical pentaerythritol with a mixture $C_5$ to $C_{10}$ acids was employed along with a standard additive package containing from 1.7–2.5% by weight aryl amine antioxidants, 0.5–2% tri-aryl phosphates, and 0.1% benzo or alkyl-benzotriazole. To this was added various load-carrying additive package which consisted of the following:

1) Amine phosphate alone: Vanlube 692, a mixed mono-/di-acid phosphate amine, sold commercially by R.T. Vanderbilt 2) TECA alone: exemplified by 3,3'-thiodipropionic acid (a thioether carboxylic acid, TECA) commercially available from numerous chemical suppliers such as Sigma, Aldrich, etc.

3) Combination (present invention): the combination of the two materials described in (1) and (2).

The load-carrying capacity of these oils was evaluated in 4 Ball and severe FZG gear tests. The 4 Ball performance is reported in terms of initial seizure load (ISL) defined as the average of the maximum passing and minimum failing load values obtained when the load is increased at an increment of 5 Kg. The failure criterion is the scuffing/wear scar diameter on a test ball to exceed 1 mm at the end of 1 minute run at room temperature under 1500 RPM. The FZG gear test is an industry standard test to measure the ability of an oil to prevent scuffing of a set of moving gears as the load applied to the gears is increased. The "severe" FZG test mentioned here is distinguished from the FZG test standardized in DIN 51 354 for gear oils in that the test oil is heated to a higher temperature (140 versus 90° C.), and the maximum pitch line velocity of the gear is also higher (16.6 versus 8.3 m/s). The FZG performance is reported in terms of failure load stage (FLS), which is defined by a lowest load stage at which the sum of widths of all damaged areas exceeds one tooth width of the gear. Table 1 lists Hertz load and total work transmitted by the test gears at different load stages.

TABLE 1

| Load Stage | Hertz Load ($N/mm^2$) | Total Work (kWh) |
|---|---|---|
| 1 | 146 | 0.19 |
| 2 | 295 | 0.97 |
| 3 | 474 | 2.96 |
| 4 | 621 | 6.43 |
| 5 | 773 | 11.8 |
| 6 | 927 | 19.5 |
| 7 | 1080 | 29.9 |
| 8 | 1232 | 43.5 |
| 9 | 1386 | 60.8 |
| 10 | 1538 | 82.0 |

The OCS [FED-STD-791; Method 5308 at 400° F.] and Si seal [FED-STD-791; Method 3433] tests used here to evaluate the turbo oils were run under the standard conditions as required by the Navy MIL-L-23699 specification.

The results from the severe FZG, Si seal and OCS tests are shown in Tables 2, 3 and 4, respectively. The wt % concentrations (based on the polyol ester base stock) of the amine phosphate and TECA, either used alone or in combination are also specified in the tables. Table 2 demonstrates that the combination of the amine phosphate and the TECA exhibits an excellent load-carrying capacity, which is better than that attributed to each additive used alone at a comparable treat rate. Tables 3 and 4 show that the turbo oil formulation containing the synergistic P/S load additive combination also meets or exceeds the MIL-L-23699 OCS and Si seal specifications whereas 0.1% VL 692-containing formulation fails the Si seal test and yields the lower FZG FLS than that of the present invention.

TABLE 2

| Load Additives | Severe FZG FLS | 4 Ball ISL, Kg |
|---|---|---|
| None | 4 | 82 |
| 0.02 wt % Vanlube 692 (VL 692) | 5.3 | 92 |
| 0.10 wt % TECA | 6 | 92 |
| 0.10 wt % VL 692 | 7 or 8 | 95 |
| 0.10 wt % TECA + 0.02% VL 692 | 9 | 97 |

TABLE 3

| Load Additives | % Vis Change | Δ TAN (mg KOH/g oil) | Sludge (mg/100 cc) | Δ Cu (mg/cm²) | Δ Ag (mg/cm²) |
|---|---|---|---|---|---|
| | MIL-23699-OCS Test @ 400° F. | | | | |
| None | 14.45 | 0.83 | 0.7 | −0.07 | −0.02 |
| 0.10% TECA + 0.02% VL 692 | 8.95 | 0.41 | 2.4 | −0.13 | −0.00 |
| Limits | −5–25 | 3 | 50 | ±0.4 | ±0.2 |

TABLE 4

| Load Additives | ΔSwell | % Tensile Strength Loss |
|---|---|---|
| | Si Seal Compatibility | |
| None | 13.1 | 10.3 |
| 0.1% VL 692 | 3.9 | 84.4 |
| 0.02% VL 692 | 7.8 | 28.7 |
| 0.10 TECA + 0.02% VL 692 | 8.3 | 25.8 |
| Spec | 5–25 | <30 |

EXAMPLE 2

In these runs, a series of fully formulated turbo oils was to illustrate the performance benefits of using a mixture of amine phosphate and 2-mercapto-benzoic acid also known as thiosalicylic acid (TSA) in the load carrying test. The fully formulated turbo oils are as described in Example 1 with the exception that in the series of runs the load additive tested were the amine phosphate, Vanlube 672, Vanlube 692 and thiosalicylic acid (TSA). The severe FZG test is as described in Example 1. Table 5 demonstrates that the combination of the amine phosphate and the thiosalicylic acid exhibits an excellent load carrying capacity, which is better than that attributed to each additive used alone at a comparable treat rate.

TABLE 5

| Oil | V-672 | V-692 | TSA | Severe FZG Final Load Stage |
|---|---|---|---|---|
| | Wt % Indicated Additives | | | |
| 1 | — | — | — | 3 |
| 2 | — | 0.010 | — | 6.5 |
| 3 | 0.01 | — | — | 6.0 (average of 2 runs) |
| 4 | — | — | 0.01 | 4.5 (average of 2 runs) |
| 5 | — | 0.02 | — | 5.3 3 (average of 6 runs) |
| 6 | 0.02 | — | — | 7.1 (average of 3 runs) |
| 7 | — | — | 0.02 | 6 (1 run) |
| 8 | — | 0.01 | 0.01 | 6.7 (average of 3 runs) |
| 9 | — | 0.010 | 0.015 | 8 (average of 2 runs) |
| 10 | — | — | 0.025 | 5 (average of 6 runs) |
| 11 | 0.01 | — | 0.015 | 7 (1 run) |
| 12 | — | 0.030 | — | 6.0 (average of 8 runs) |
| 13 | 0.03 | — | — | 6.3 (average of 3 runs) |
| 14 | — | — | 0.03 | 6 (average of 4 runs) |
| 15 | — | 0.02 | 0.015 | 8 |
| 16 | 0.01 | — | 0.03 | 7(1 run) |

What is claimed is:

1. A turbo oil composition possessing high load carrying capacity comprising a major mount of a base stock of a synthetic base oil selected from diesters and polyolester base oil suitable for use as a turbo oil base stock and a minor amount of additives comprising a mixture of sulfur containing carboxylic acids SCCA, and one or more amine phosphate(s), wherein the sulfur containing carboxylic acid is represented by the structural formula:

$$R_6—S—R_5—\overset{O}{\overset{\|}{C}}—OR'$$

wherein $R^5$ is $C_1$–$C_{12}$ alkylene, arylene, $C_1$–$C_8$ alkyl substituted arylene, R' is hydrogen, $R_6$ is hydrogen, $C_1$–$C_{12}$ alkyl, aryl, $C_1$–$C_8$ alkyl substituted aryl; or the structural formula:

$$R''OOC—R_7—S—R_5—COOR'$$

$$R''OOC—R_7—S—R_5—COOR'$$

wherein $R_5$ and $R_7$ are the same or different and are $C_1$–$C_{12}$ alkylene, arylene, $C_1$–$C_8$ alkyl substituted arylene, and R' and R" are the same or different and are hydrogen, $C_1$–$C_8$ alkyl provided that at least one of R' and R" is hydrogen, wherein the SCCA is present in an amount by weight in the range 100 to 1000 ppm and the amine phosphate is present in an amount in the range 50 to 300 ppm, all based on base stock.

2. The turbo oil of claim 1 wherein the base stock is a synthetic polyol ester.

3. The turbo oil of claim 1 wherein the sulfur containing carboxylic acid is represented by the structural formula $$R''OOC—R_7—S—R_5—COOR'$$

where $R_5$ and $R_7$ are the same or different and are $C_1$–$C_{12}$ alkylene and R' and R" are the same or different and are H or $C_1$–$C_8$ alkyl provided that at least one of R' and R" are hydrogen.

4. The turbo oil of claim 3 wherein the $R_5$ and $R_7$ are linear $C_1$–$C_4$ alkylene and R' and R" are both hydrogen.

5. The turbo oil of claim 1 wherein the sulfur containing carboxylic acid is represented by the structural formula:

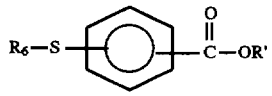

wherein R' is hydrogen, $R_6$ is hydrogen, $C_1$–$C_{12}$ alkyl, aryl, $C_1$–$C_8$ alkyl substituted aryl; or the structural formula:

$$R''OOC—R^7—S—R^5—COOR'$$

wherein $R^7$ is $C_1$–$C_{12}$ alkylene, arylene, $C_1$–$C_8$ alkyl substituted arylene the same or different and are hydrogen, $C_1$–$C_8$ alkyl provided that at least one of R' and R" is hydrogen.

6. The turbo oil of claim 5 wherein R' and R" are both hydrogen.

7. The turbo oil of claim 1 wherein the amine phosphate and the SCCA are used in a weight ratio of 1:1 to 1:10.

8. The turbo oil of claim 1, 2, 3, 4, 5, 6 or 7 wherein the amine phosphate is monobasic hydrocarbyl amine salts of mixed mono- and di-acid phosphates.

9. The turbo oil of claim 1, 2, 3, 4, 5, 6 or 7 wherein the amine phosphate is monobasic hydrocarbyl amine salt of the diacid phosphate.

10. The turbo oil of claim 8 wherein the amine phosphate is of the structural formula

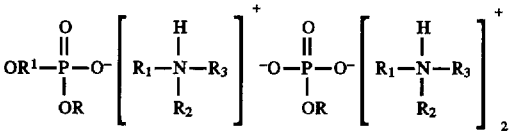

where R and $R^1$ are the same or different and are $C_1$ to $C_{12}$ linear or branched chain alkyl;

$R_1$ and $R_2$ are H or $C_1$–$C_{12}$ linear or branched chain alkyl;

$R_3$ is $C_4$ to $C_{12}$ linear or branched chain alkyl or aryl —$R_4$ or $R_4$-aryl where $R_4$ is H or $C_1$–$C_{12}$ alkyl, and aryl is $C_6$.

11. The turbo oil of claim 10 wherein R and $R^1$ are $C_1$ to $C_6$ alkyl, and $R_1$ and $R_2$ are H or $C_1$–$C_4$ alkyl, and $R_3$ is aryl-$R_4$ where $R_4$ is linear chain $C_4$–$C_{12}$ alkyl, or $R_3$ is linear or branched $C_8$–$C_{12}$ alkyl, and aryl is $C_6$.

12. The turbo oil of claim 10 wherein the amine phosphate and the SCCA are used in a weight ratio of 1:1.5 to 1:5.

* * * * *